US010294760B2

(12) United States Patent
McNamee et al.

(10) Patent No.: US 10,294,760 B2
(45) Date of Patent: May 21, 2019

(54) SAND CONTROL SCREEN

(71) Applicant: Weatherford Technology Holdings, LLC, Houston, TX (US)

(72) Inventors: Stephen McNamee, Cypress, TX (US); John Steven Sladic, Katy, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 235 days.

(21) Appl. No.: 15/276,480

(22) Filed: Sep. 26, 2016

(65) Prior Publication Data

US 2017/0089183 A1 Mar. 30, 2017

Related U.S. Application Data

(60) Provisional application No. 62/234,530, filed on Sep. 29, 2015.

(51) Int. Cl.

| | |
|---|---|
| ***E21B 43/08*** | (2006.01) |
| ***E21B 17/042*** | (2006.01) |
| ***E21B 43/10*** | (2006.01) |

(52) U.S. Cl.

CPC ..... *E21B 43/08* (2013.01); *E21B 17/042* (2013.01); *E21B 43/086* (2013.01); *E21B 43/106* (2013.01)

(58) Field of Classification Search

CPC ..... E21B 43/08; E21B 43/082; E21B 43/084; E21B 43/086; E21B 43/088; E21B 43/10; E21B 43/103; E21B 43/106; E21B 43/108

USPC ..... 166/227–236

See application file for complete search history.

(56) References Cited

U.S. PATENT DOCUMENTS

| | | | | |
|---|---|---|---|---|
| 4,167,972 | A * | 9/1979 | Sears | B01D 29/15 166/233 |
| 5,295,538 | A * | 3/1994 | Restarick | E21B 23/02 166/147 |
| 5,979,551 | A * | 11/1999 | Uban | E21B 43/088 166/231 |
| 2002/0189809 | A1* | 12/2002 | Nguyen | E21B 43/045 166/278 |
| 2003/0029613 | A1* | 2/2003 | Danos | E21B 17/02 166/278 |
| 2014/0360718 | A1 | 12/2014 | Ma et al. | |
| 2015/0192008 | A1* | 7/2015 | Dikshit | E21B 47/1015 166/250.12 |

OTHER PUBLICATIONS

Australian Examination Report dated Jun. 2, 2017, for Australian Patent Application No. 2016234920.

* cited by examiner

*Primary Examiner* — Brad Harcourt
*Assistant Examiner* — David Carroll
(74) *Attorney, Agent, or Firm* — Patterson & Sheridan, LLP

(57) ABSTRACT

The present disclosure relates to apparatus and methods for isolating a tool, such as a sand control screen, from axial and/or torsional loads applied to a tubular string. A sand screen assembly includes a sand control screen, a fixed-end coupling, and a free-end coupling. A first end of the sand control screen is coupled to the fixed-end coupling by a secure connection, and a second end of the sand control screen is coupled to the free-end coupling so the second end of the sand control screen is free to rotate or move axially relative to the free-end coupling.

20 Claims, 5 Drawing Sheets

SAND CONTROL SCREEN

BACKGROUND

Field

Embodiments of the present disclosure relate to apparatus and methods for mounting a tool in a tubular string for well operations. More particularly, embodiment of the present disclosure relates to apparatus and methods for mounting a sand control screen inside a liner.

Description of the Related Art

During well operations, such as drilling, completion and production, sand control screens are frequently installed in wellbores to control sand production from a well. Sand control screens are usually installed in wellbores by running-in-hole operation while attached to a tubular string, such as a drilling string. However, structures of sand control screens have limited tolerance to axial and torsional loads. The magnitude of axial loads and/or torsional loads applied to a tubular string during running-in-hole operations, may cause damage to the sand control screens resulting in loss of sand control.

Therefore, there is a need for apparatus and methods for mounting sand control screens to protect sand control screens from increased axial and/or torsional loads.

SUMMARY

Embodiments of the present disclosure relate to apparatus and methods for mounting a sand control screen inside a liner.

One embodiment provides a screen assembly. The screen assembly includes a sand control screen, a fixed-end coupling, wherein a first end of the sand control screen is coupled to the fixed-end coupling by a secure connection, and a free-end coupling, wherein a second end of the sand control screen is movably coupled to the free-end coupling.

In one embodiment, the second end of the sand control screen is free to rotate or move axially relative to the free-end coupling. In one embodiment, the secure connection is a threaded connection.

In one embodiment, the screen assembly further includes a seal element disposed between the second end of the sand control screen and the free-end coupling.

In one embodiment, the screen assembly further includes a tubular liner having a central bore, wherein the sand control screen is disposed in the central bore of the tubular liner, a first end of tubular liner is coupled to the fixed-end coupling by a secure connection, and a second end of the tubular liner is coupled to the free-end coupling by a secure connection.

In one embodiment, the fixed-end coupling comprises a tubular body having a first box section, a second box section, and a middle section between the first box section and the second box section, an inner diameter of the middle section is smaller than the first box section, the first end of the sand control screen is coupled to the middle section, and the first end of the tubular liner is coupled to the first box section.

In one embodiment, the free-end coupling comprises a tubular body having a first box section, a second box section, and a middle section between the first box section and the second box section, an inner diameter of the middle section is smaller than the first box section, the second end of the sand control screen is coupled to the middle section, and the second end of the tubular liner is coupled to the first box section.

In one embodiment, the tubular liner is perforated.

Another embodiment provides a method for deploying a tubular string in a wellbore. The method includes coupling a sand screen assembly to a tubular string, and running the tubular string and the sand screen assembly into the wellbore. The sand screen assembly includes a sand control screen, a fixed-end coupling, wherein a first end of the sand control screen is coupled to the fixed-end coupling by a secure connection, and a free-end coupling, wherein a second end of the sand control screen is coupled to the free-end coupling so the second end of the sand control screen is free to rotate or move axially relative to the free-end coupling.

In one embodiment, the method further includes assembling the sand screen assembly by attaching the first end of the sand control screen to the fixed-end coupling, attaching a first end of a tubular liner to the fixed end coupling, and attaching the free-end coupling simultaneously to the sand control screen and the tubular liner.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
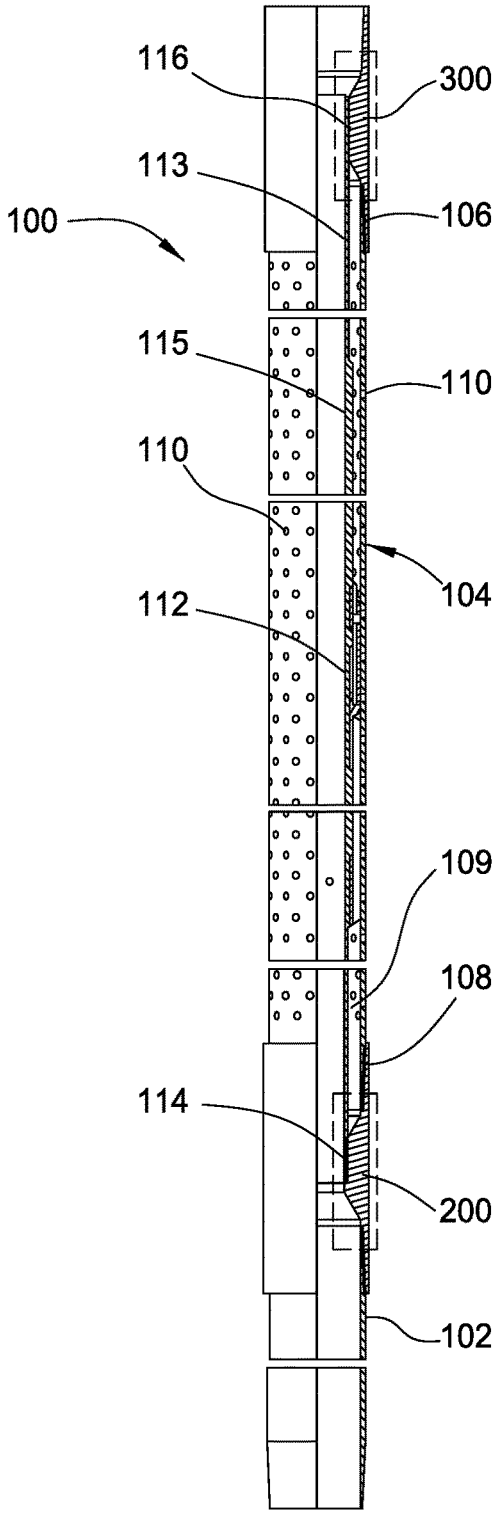
FIG. 1 is a schematic sectional view of a sand control screen mounted between two couplings according to one embodiment of the present disclosure.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

The descriptions of the various embodiments are presented for illustrative purposes and are not intended to be exhaustive or limiting. Many modifications and variations will be apparent to those of ordinary skill in the art without departing from the scope and spirit of the described embodiments. The terminology used herein was chosen to best explain the principles of the embodiments, the practical applications or technical improvements over technologies found in the marketplace, or to enable others of ordinary skill in the art to understand the embodiments disclosed herein.

FIG. 1 is a schematic sectional view of a sand screen assembly 100 having a sand control screen 112 mounted between two couplings according to one embodiment of the present disclosure. The sand control screen 112 may be coupled between a fixed-end coupling 200 and a free-end coupling 300. The fixed end coupling 200 may be coupled between the sand screen assembly 100 and a tubular sub 102 that can be connected to a tubular string. The tubular string may be a drill string, a casing string, or any suitable string that can be deployed down a wellbore. In one embodiment, the sand screen assembly 100 may include a perforated liner such as a pre-drilled liner 104 disposed around the sand control screen 112.

The pre-drilled liner 104 may be a tubular having a central bore 109 and a plurality of through holes 110 formed through a wall of the tubular. An upper end 106 of the pre-drilled liner 104 may be coupled to the free-end coupling 300. A lower end 108 of the pre-drilled liner 104 may be coupled to the fixed-end coupling 200. The connection between the free-end coupling 300 and the pre-drilled liner 104 may be a connection that enables transmission of axial load and/or torsional loads. The connection between the fixed-end coupling 200 and the pre-drilled liner 104 may be a connection that enables transmission of axial load and/or torsional loads. In one embodiment, the pre-drilled liner 104 transmits axial and torsional loads between the fixed-end coupling 200 and the free-end coupling 300. In one embodiment, the upper end 106 of the pre-drilled liner 104 may be coupled to the free-end coupling 300 by a threaded connection. In one embodiment, the lower end 108 of the pre-drilled liner 104 may be coupled to the fixed-end coupling 200 by a threaded connection. Alternatively, the pre-drilled liner 104 may be connected to the fixed-end coupling 200 and the free-end coupling 300 using any suitable connection that allows transmission of axial and/or torsional loads, for example, by one or more bolts.

The sand control screen 112 may be disposed in the central bore 109 of the pre-drilled liner 104. An outer diameter of the sand control screen 112 may be smaller than an inner diameter of the pre-drilled liner 104. In one embodiment, the sand control screen 112 is co-axially disposed in the pre-drilled liner 104.

In one embodiment, the sand control screen 112 may be a wired-wrapped screen having a wire wrapping sections 115 along a base pipe 113. In another embodiment, the sand control screen 112 may include separate wire wrapping sections 115 applied to a single base pipe 113 at various intervals. For example, the sand control screen 112 may be the MAZEFLO™ completion screen available from ExxonMobil Corporation. Alternatively, the sand control screen 112 may be any suitable sand screen having redundant control and baffled compartments over sand and gravel while allowing continued hydrocarbon flow therethrough.

In the embodiment of FIG. 1, a lower end 114 of the base pipe 113 is coupled to the fixed-end coupling 200. In one embodiment, the base pipe 113 may be attached to the fixed-end coupling 200 in a manner that the base pipe 113 does not rotate or move axially relatively to the fixed-end coupling 200 during operation. For example, the base pipe 113 may be threadedly coupled to the fixed-end coupling 200. Alternatively, the base pipe 113 may be couple to the fixed-end coupling 200 using any suitable connection that prevents the base pipe 113 from rotating or moving axially relative to the fixed-end coupling 200, for example, by one or more bolts.

An upper end 116 of the base pipe 113 is coupled to the free-end coupling 300. In one embodiment, the base pipe 113 may be coupled to the free-end coupling 300 in a manner that allows the base pipe 113 to rotate and move axially relatively to the free end coupling 300 during operation. In one embodiment, the upper end 116 of the base pipe 113 is inserted into the free-end coupling 300 so that an outer surface of the upper end 116 contacts an inner surface of the free-end coupling 300. In this respect, the upper end 116 of the base pipe 113 isolates the sand control screen 112 from any axial loading and torsional loading passing between the free-end coupling 300 and the fixed end coupling 200, therefore, preventing the axial load and torsional load from damaging the sand control screen 112.

In one embodiment, to assemble the sand screen assembly 100, the fixed-end coupling 200 may be first threadedly connected to a tubular sub 102 that can be connected to the tubular string. The lower end 114 of the sand control screen 112 may then be connected to the fixed-end coupling 200. The lower end 108 of the pre-drilled liner 104 is then made up to the fixed-end coupling 200. The free-end coupling 300 is then coupled to the sand control screen 112 and the pre-drilled liner 104 simultaneously. For example, the free-end coupling 300 may be coupled to the pre-drilled liner 104 at the upper end 106 using a threaded connection while the upper end 116 of the base pipe 113 is inserted into the free-end coupling 300. Additional tubulars and/or subs may be coupled to the free-end coupling 300 and tubular sub 102 to run the sand screen assembly 100 downhole.

Figure 2A:
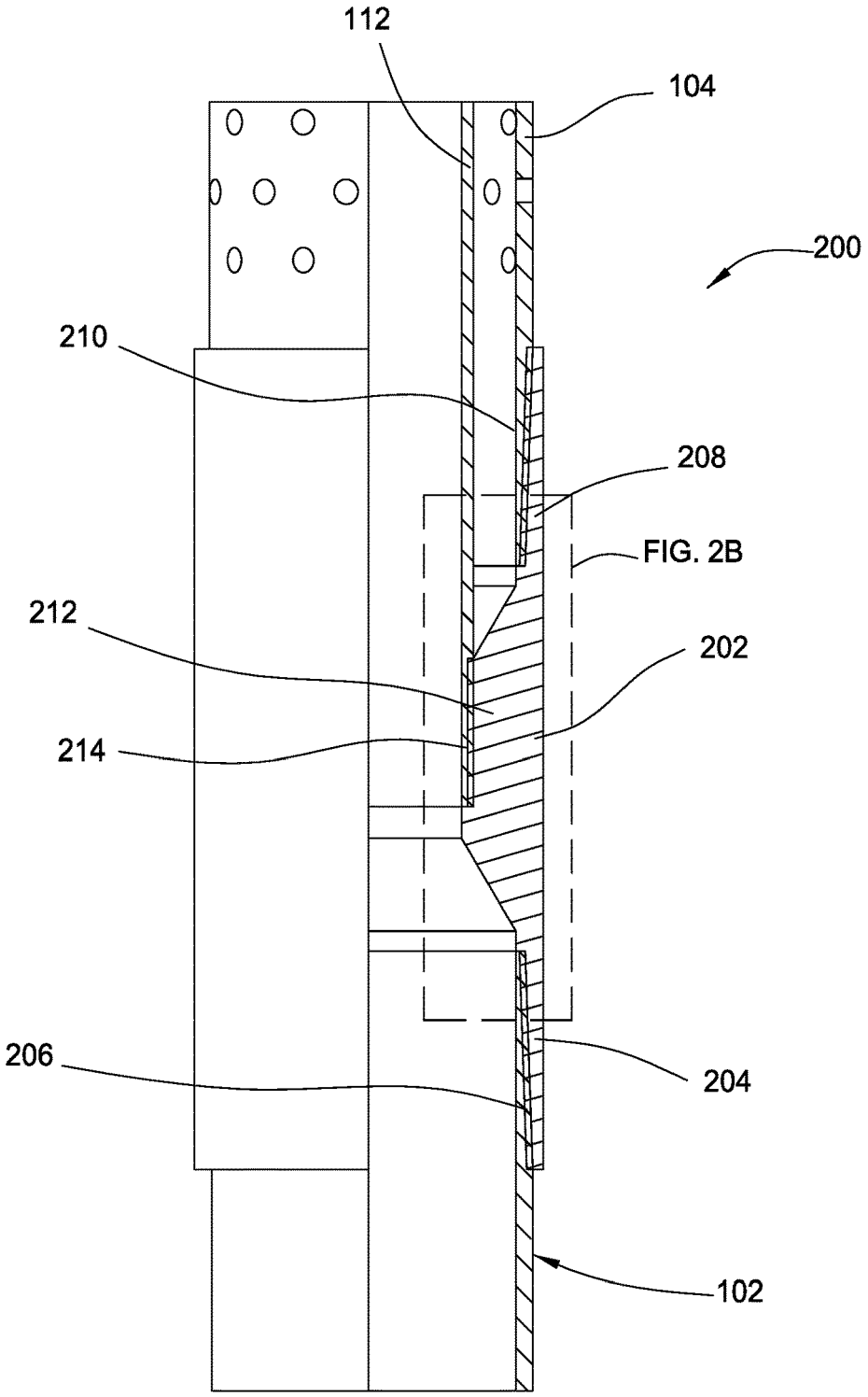
FIG. 2A is an enlarged sectional view of a coupling coupled to a lower end of the sand control screen.
Figure 2B:
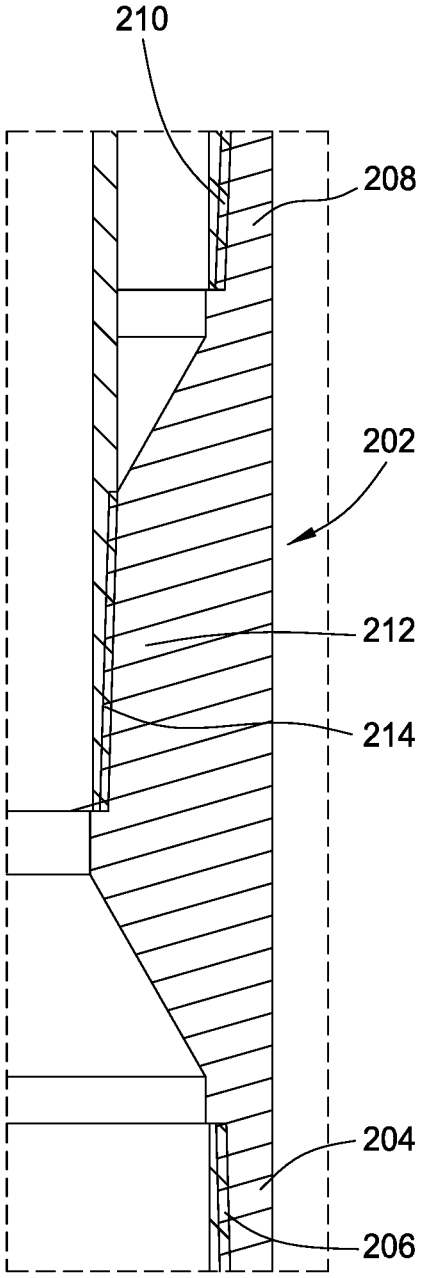
FIG. 2B is a partial enlarge view of the coupling of FIG. 2A.

FIG. 2A is an enlarged sectional view of the fixed-end coupling 200 connected between the tubular sub 102 and the sand control screen 112. FIG. 2B is a partial enlarge view of the fixed-end coupling 200. The fixed-end coupling 200 may have a tubular body 202. The tubular body 202 may have a lower box 204, an upper box 208, and a middle section 212 with a reduced inner diameter between the lower box 204 and the upper box 208. The inner diameter of the upper box 208 is larger than the inner diameter of the middle section 212. In one embodiment, the lower box 204 may have a threaded connection formed on an inner surface to connect with a pin, for example, a pin on the tubular sub 102. The upper box 208 may have a threaded connection 210 formed on an inner surface to connect with a pin, for example, a pin formed on the lower end of the pre-drilled pipe 104. The middle section 212 may have a threaded connection 214 formed on the inner surface. The threaded connection 214 may be configured to form a secure connection with the lower end 114 of the sand control screen 112. Alternatively, the threaded connections 206, 210 may be replaced by any suitable connection to allow transmission of axial and torsional loads. The threaded connection 214 may be any suitable connection to form a secure connection.

Figure 3A:
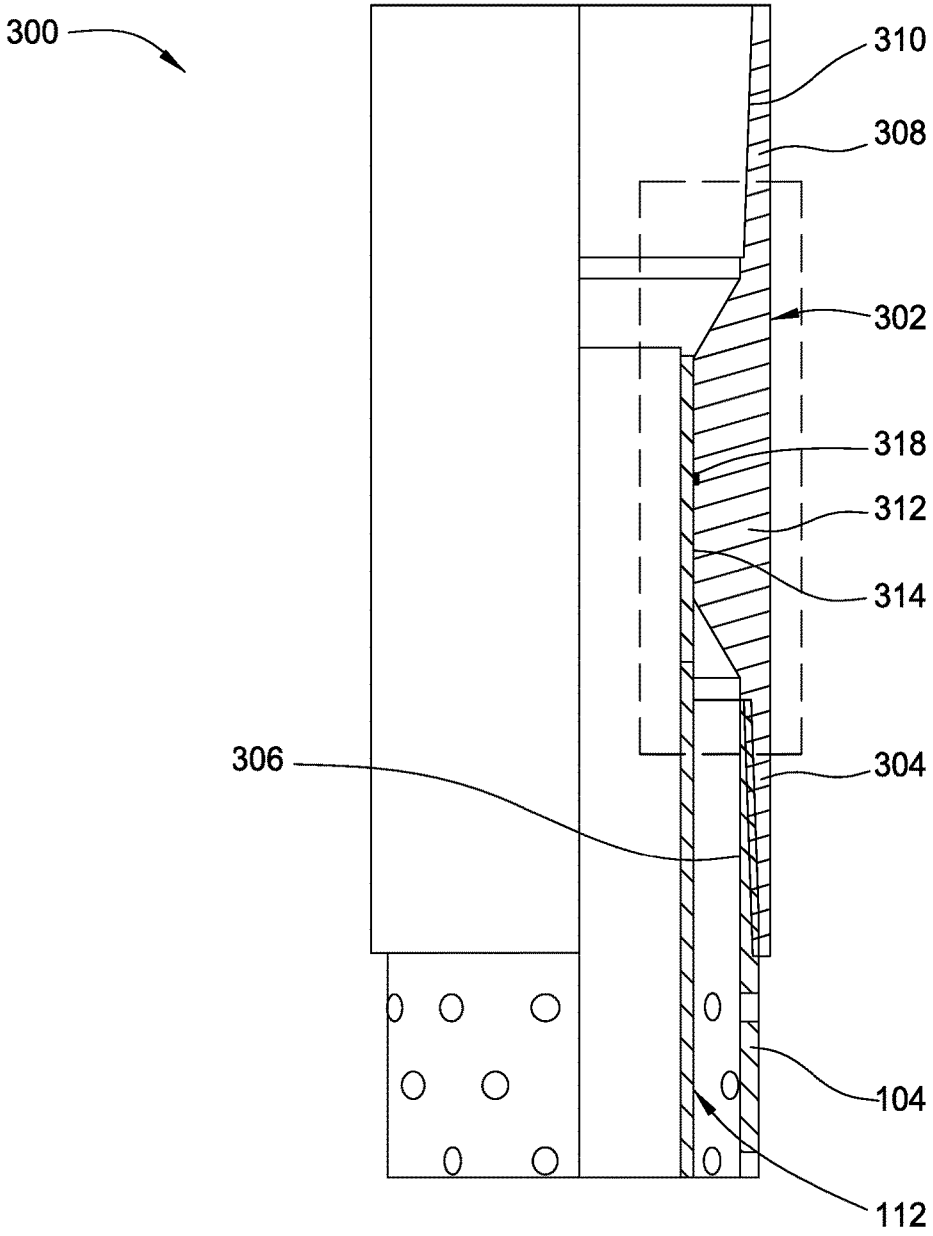
FIG. 3A is an enlarged sectional view of a coupling coupled to an upper end of the sand control screen.
Figure 3D:
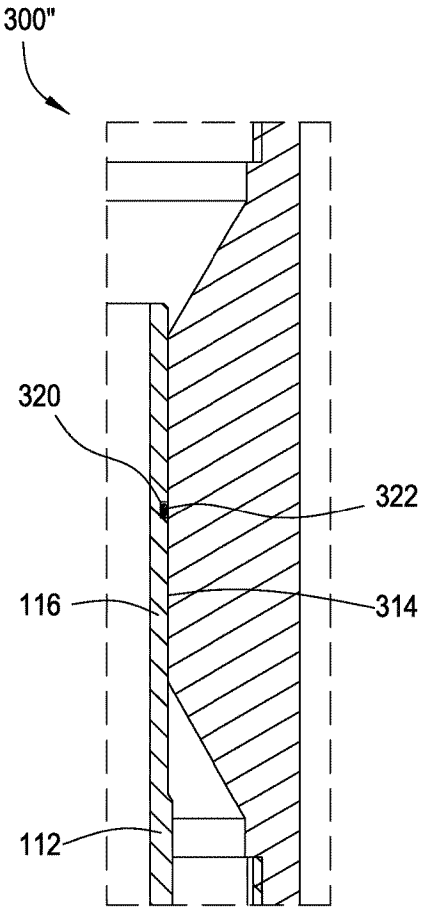
FIG. 3D is another embodiment of the coupling of FIG. 3A.

FIG. 3A is an enlarged sectional view of the free-end coupling 300 connected to the sand control screen 112. FIG. 3B is a partial enlarge view of the free-end coupling 300. The free-end coupling 300 may have a tubular body 302. The tubular body 302 may have a lower box 304, an upper box 308, and a middle section 312 with a reduced inner diameter between the lower box 304 and the upper box 308. The inner diameter of the lower box 304 is larger than the inner diameter of the middle section 312. In one embodiment, the lower box 304 may have a threaded connection formed on an inner surface to connect with a pin, for example, a pin on the pre-drilled pipe 104. The upper box 308 may have a threaded connection 310 formed on an inner surface to connect with a pin, for example, a pin formed on another tool or a tubular. Alternatively, the threaded connections 306, 310 may be replaced by any suitable connection to allow transmission of axial and torsional loads.

The middle section 312 may have a smooth inner surface 314. The smooth inner surface 314 may be configured to house the upper end 116 of the sand control screen 112 therein. The smooth inner surface 314 allows the sand control screen 112 to rotate and move axially.

In one embodiment, a groove 316 may be formed in the inner surface 314. A seal member 318 may be disposed in the groove 316. The seal member 318 may be configured to form a seal between the free-end coupling 300 and the sand control screen 112. In one embodiment, the seal member 318 may be an O-ring seal. Alternatively, any suitable seal configurations, such as a chevron seal, may be used between the free-end coupling 300 and the upper end 116 of the sand control screen 112.

Figure 3C:
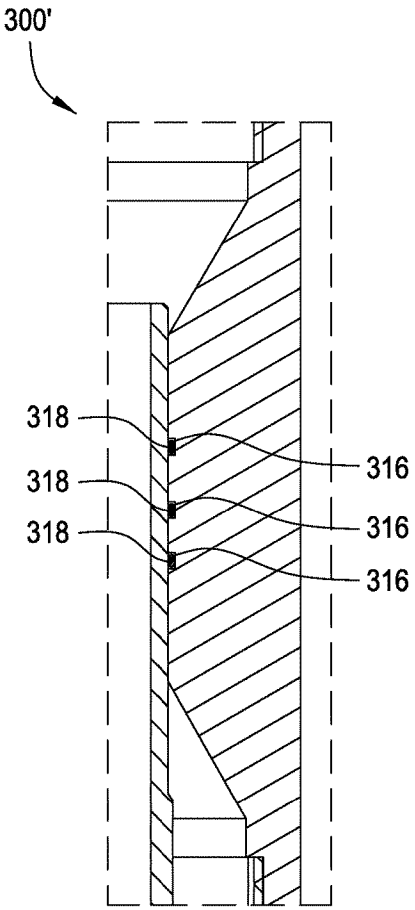
FIG. 3C is an alternative embodiment of the coupling of FIG. 3A.
Figure 3B:
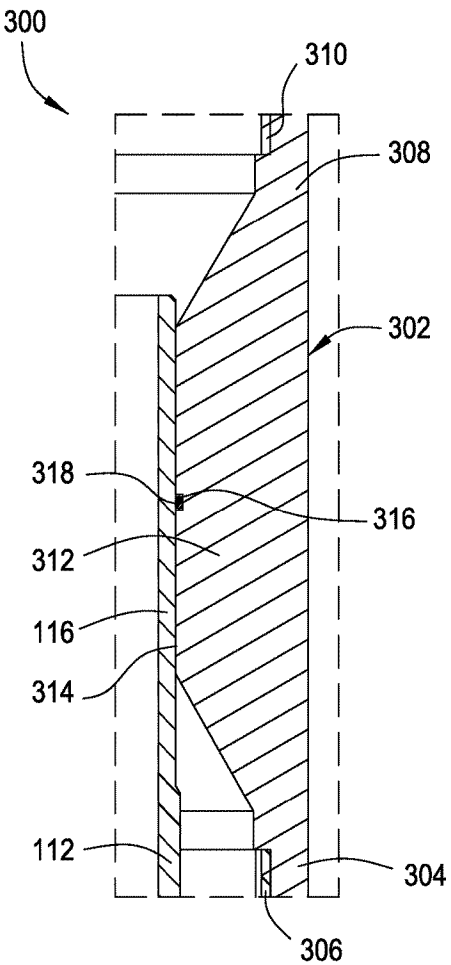
FIG. 3B is a partial enlarge view of the coupling of FIG. 3A.

FIG. 3C is an alternative embodiment of the free-end coupling 300'. The free-end coupling 300' is similar to the free-end coupling 300 except that the free-end coupling 300' includes two or more seal members 318 disposed in grooves 318 formed in the inner surface 314.

FIG. 3D is an alternative embodiment of the free-end coupling 300". The free-end coupling 300" is similar to the free-end coupling 300 except that the free-end coupling 300" includes a seal member 322 disposed in a groove 320 formed in an outer surface of the upper end 116 of the sand control screen 112. In yet another embodiment, one or more seal members may be disposed on the upper end 116, the free-end coupling 300, or both.

Embodiment of the present disclosure isolates sand screens from axial and torsional loads applied to a tubular string, therefore, allowing operations to apply increased axial and torsional loads to the tubular string to deploy the tubular string to a greater depth or to more challenging wells.

Even though the fixed end coupling 200 is disposed on a lower end of the sand control screen and the free-end coupling 300 is disposed on an upper end of the sand control screen, the location of the free-end coupling 200 and the fixed-end coupling 300 may be switched.

In one embodiment, a screen assembly having a sand control screen; a fixed-end coupling, wherein a first end of the sand control screen is coupled to the fixed-end coupling by a secure connection; and a free-end coupling, wherein a second end of the sand control screen is movably coupled to the free-end coupling.

In another embodiment, a screen assembly includes a sand control screen; a perforated tubular; a first coupling, wherein a first end of the sand control screen and a first end of the perforated tubular are connected to the first coupling; and a second coupling, wherein a second end of the sand control screen is movably coupled to the second coupling and a second end of the perforated tubular is connected to the second coupling.

Embodiments of the present disclosure provide a screen assembly. The screen assembly includes a sand control screen, a fixed-end coupling, wherein a first end of the sand control screen is coupled to the fixed-end coupling by a first secure connection, and a free-end coupling, wherein a second end of the sand control screen is movably coupled to the free-end coupling.

In one or more embodiment, the second end of the sand control screen is axially movable relative to the free-end coupling.

In one or more embodiment, the second end of the sand control screen is rotatable relative to the free-end coupling.

In one or more embodiment, the first secure connection is a threaded connection.

In one or more embodiment, the screen assembly further includes a seal element disposed between the second end of the sand control screen and the free-end coupling.

In one or more embodiment, the screen assembly further includes a tubular liner having a central bore. The sand control screen is disposed in the central bore of the tubular liner. A first end of tubular liner is coupled to the fixed-end coupling by a second secure connection. A second end of the tubular liner is coupled to the free-end coupling by a third secure connection.

In one or more embodiment, the fixed-end coupling comprises a tubular body having a first section, a second section, and a middle section between the first section and the second section, an inner diameter of the middle section is smaller than the first section. The first end of the sand control screen is coupled to the middle section by the first secure connection, and the first end of the tubular liner is coupled to the first section by the second secure connection.

In one or more embodiment, the middle section of the fixed-end coupling includes a threaded connection.

In one or more embodiment, the free-end coupling comprises a tubular body having a first section, a second section, and a middle section between the first section and the second section. An inner diameter of the middle section is smaller than the first section. The second end of the sand control screen is coupled to the middle section. The second end of the tubular liner is coupled to the first box section.

In one or more embodiment, an inner surface of the middle section of the free-end coupling houses an outer surface of the second end of the sand control screen.

One embodiment of the present disclosure provides a screen assembly. The screen assembly includes a sand control screen, a perforated tubular disposed radially outward the sand control screen, a first coupling, wherein a first end of the sand control screen and a first end of the perforated tubular are connected to the first coupling, and a second coupling, wherein a second end of the sand control screen is movably coupled to the second coupling and a second end of the perforated tubular is connected to the second coupling.

In one or more embodiment, the first coupling comprises a tubular body having a first section, a second section, and a middle section between the first section and the second section, an inner diameter of the middle section is smaller than the first section, the middle section is coupled to the sand control screen, and first section is coupled to the perforated tubular.

In one or more embodiment, the first section of the first coupling and the perforated tubular are coupled together by a threaded connection, and the middle section of the first coupling and the sand control screen are coupled together by a threaded connection.

In one or more embodiment, the second coupling comprises a tubular body having a first section, a second section, and a middle section between the first section and the second section, an inner diameter of the middle section is smaller than the first section, the middle section is movably coupled to the sand control screen, and first section is coupled to the perforated tubular.

In one or more embodiment, the first section of the second coupling and the perforated tubular are coupled together by a thread connection, and the middle section of the second coupling includes a smooth inner surface for housing an outer surface of the sand control screen.

In one or more embodiment, the screen assembly further includes a seal disposed between the second coupling and the sand control screen.

In one or more embodiment, the seal is disposed in a groove formed in the inner surface of the middle section of the second coupling.

One embodiment of the present disclosure provides a method of deploying a tubular string in a wellbore. The method includes coupling a sand screen assembly to a tubular string. The sand screen assembly includes a sand control screen, a fixed-end coupling, wherein a first end of the sand control screen is coupled to the fixed-end coupling by a secure connection, and a free-end coupling, wherein a second end of the sand control screen is coupled to the free-end coupling so the second end of the sand control screen is free to rotate or move axially relative to the free-end coupling. The method further includes running the tubular string and the sand screen assembly into the wellbore.

In one or more embodiment, the method further includes attaching the first end of the sand control screen to the fixed-end coupling, attaching a first end of a tubular liner to the fixed end coupling, and attaching the free-end coupling simultaneously to the sand control screen and the tubular liner.

Even though the above embodiments are directed to apparatus and methods for mounting a sand control screen, embodiment of the present disclosure may be used to mount any tubular structures when protection against axial and/or torsional loads is desired.

While the foregoing is directed to embodiments of the present disclosure, other and further embodiments of the disclosure may be devised without departing from the basic scope thereof, and the scope of the present invention is determined by the claims that follow.

The invention claimed is:

1. A screen assembly, comprising:

a sand control screen;

a fixed-end coupling, wherein a first end of the sand control screen is coupled to the fixed-end coupling by a first secure connection; and a free-end coupling, wherein a second end of the sand control screen extends through a middle section of the free-end coupling having a smooth inner surface to be movably coupled to the free-end coupling.

2. The screen assembly of claim 1, wherein the second end of the sand control screen is axially movable relative to the free-end coupling.

3. The screen assembly of claim 1, wherein the second end of the sand control screen is rotatable relative to the free-end coupling.

4. The screen assembly of claim 2, wherein the second end of the sand control screen is rotatable relative to the free-end coupling.

5. The screen assembly of claim 1, wherein the first secure connection is a threaded connection.

6. The screen assembly of claim 1, further comprising:

a seal element disposed between the second end of the sand control screen and the free-end coupling.

7. The screen assembly of claim 1, further comprising:

a tubular liner having a central bore, wherein the sand control screen is disposed in the central bore of the tubular liner, a first end of the tubular liner is coupled to the fixed-end coupling by a second secure connection, and a second end of the tubular liner is coupled to the free-end coupling by a third secure connection.

8. The screen assembly of claim 7, wherein the fixed-end coupling comprises a tubular body having a first section, a second section, and a middle section between the first section and the second section, an inner diameter of the middle section is smaller than an inner diameter of the first section, the first end of the sand control screen is coupled to the middle section by the first secure connection, and the first end of the tubular liner is coupled to the first section by the second secure connection.

9. The screen assembly of claim 8, wherein the middle section of the fixed-end coupling includes a threaded connection.

10. The screen assembly of claim 7, wherein the free-end coupling comprises a tubular body having a first section, a second section, and the middle section between the first section and the second section, an inner diameter of the middle section is smaller than an inner diameter of the first section, the second end of the sand control screen is coupled to the middle section, and the second end of the tubular liner is coupled to the first section by the third connection.

11. The screen assembly of claim 10, wherein an inner surface of the middle section of the free-end coupling houses an outer surface of the second end of the sand control screen.

12. A screen assembly, comprising:

a sand control screen;

a perforated tubular disposed radially outward the sand control screen;

a first coupling, wherein a first end of the sand control screen and a first end of the perforated tubular are connected to the first coupling; and a second coupling, wherein a second end of the sand control screen extends through a middle section of the free-end coupling having a smooth inner surface to be movably coupled to the second coupling, and a second end of the perforated tubular is connected to the second coupling.

13. The screen assembly of claim 12, wherein the first coupling comprises a tubular body having a first section, a second section, and a middle section between the first section and the second section, an inner diameter of the middle section is smaller than an inner diameter of the first section, the middle section is coupled to the sand control screen, and the first section is coupled to the perforated tubular.

14. The screen assembly of claim 13, wherein the first section of the first coupling and the perforated tubular are coupled together by a threaded connection, and the middle section of the first coupling and the sand control screen are coupled together by a threaded connection.

15. The screen assembly of claim 12, wherein the second coupling comprises a tubular body having a first section, a second section, and the middle section between the first section and the second section, an inner diameter of the middle section is smaller than an inner diameter of the first section, the middle section is movably coupled to the sand control screen, and the first section is coupled to the perforated tubular.

16. The screen assembly of claim 15, wherein the first section of the second coupling and the perforated tubular are coupled together by a thread connection, and the middle section of the second coupling includes a smooth inner surface for housing an outer surface of the sand control screen.

17. The screen assembly of claim 16, further comprising a seal disposed between the second coupling and the sand control screen.

18. The screen assembly of claim 17, wherein the seal is disposed in a groove formed in the inner surface of the middle section of the second coupling.

19. A method of deploying a tubular string in a wellbore, comprising:

coupling a sand screen assembly to a tubular string, wherein the sand screen assembly includes:

a sand control screen;

a fixed-end coupling, wherein a first end of the sand control screen is coupled to the fixed-end coupling by a secure connection; and a free-end coupling, wherein a second end of the sand control screen extends through a middle section of the free-end coupling having a smooth inner surface to be coupled to the free-end coupling so the second end of the sand control screen is free to rotate or move axially relative to the free-end coupling; and running the tubular string and the sand screen assembly into the wellbore.

20. The method of claim 19, further comprising assembling the sand screen assembly, comprising:

attaching the first end of the sand control screen to the fixed-end coupling;

attaching a first end of a tubular liner to the fixed end coupling; and attaching the free-end coupling simultaneously to the sand control screen and the tubular liner.

* * * * *